US010246806B2

(12) United States Patent
Lim et al.

(10) Patent No.: US 10,246,806 B2
(45) Date of Patent: Apr. 2, 2019

(54) ECONOMICAL FIRE BARRIER NONWOVEN

(71) Applicant: Tintoria Piana US, Inc., Cartersville, GA (US)

(72) Inventors: Sang-hoon Lim, Cartersville, GA (US); Andrea Piana, Cartersville, GA (US)

(73) Assignee: TINTORIA PIANA US, INC., Cartersville, GA (US)

( * ) Notice: Subject to any disclaimer, the term of this patent is extended or adjusted under 35 U.S.C. 154(b) by 455 days.

(21) Appl. No.: 15/132,623

(22) Filed: Apr. 19, 2016

(65) Prior Publication Data

US 2016/0355963 A1 Dec. 8, 2016

Related U.S. Application Data

(60) Provisional application No. 62/170,806, filed on Jun. 4, 2015.

(51) Int. Cl.

| | |
|---|---|
| ***D04H 3/00*** | (2012.01) |
| ***D04H 3/013*** | (2012.01) |
| ***D04H 1/425*** | (2012.01) |
| ***D04H 1/4258*** | (2012.01) |
| ***D04H 1/4382*** | (2012.01) |
| ***D04H 1/542*** | (2012.01) |

(52) U.S. Cl.

CPC ..... *D04H 3/013* (2013.01); *D04H 1/425* (2013.01); *D04H 1/4258* (2013.01); *D04H 1/4382* (2013.01); *D04H 1/542* (2013.01); *D10B 2201/00* (2013.01); *D10B 2503/00* (2013.01)

(58) Field of Classification Search

CPC ..... D04H 3/013; D04H 1/425; D04H 1/4258; D04H 1/4382; D04H 1/542; D10B 2201/00; D10B 2503/00

See application file for complete search history.

(56) References Cited

U.S. PATENT DOCUMENTS

| | | | | |
|---|---|---|---|---|
| 7,259,117 | B2 | 8/2007 | Mater | |
| 7,410,920 | B2 | 8/2008 | Davis | |
| 2007/0066175 | A1 | 3/2007 | Wolf et al. | |
| 2011/0070419 | A1 | 3/2011 | Lim et al. | |
| 2012/0301694 | A1* | 11/2012 | Lim ..... | D04H 1/425 428/219 |
| 2014/0017406 | A1 | 1/2014 | Lim et al. | |
| 2014/0261852 | A1 | 9/2014 | Bonner et al. | |
| 2015/0096125 | A1 | 4/2015 | DeFranks et al. | |

OTHER PUBLICATIONS

Harju et al., Emerging New Brominated Flame Retardants, Norwegian Pollution Control, 2009, pp. 1-114 (Year: 2009).*

David R. Lide, CRC Handbook of Chemistry and Physics, Mar. 2007.

* cited by examiner

*Primary Examiner* — Cephia D Toomer

(74) *Attorney, Agent, or Firm* — W&C IP

(57) ABSTRACT

Provided herein is a new fire barrier nonwoven composed of flame retardant (FR) cellulosic fiber(s) and untreated cellulosic fiber(s) and optionally a binder fiber and methods of making the same, wherein the FR cellulosic fiber contains FR chemical(s) or FR compound(s) that have melting point or decomposition temperature at 400° C. (752° F.) or below. The FR performance of the new nonwoven provided herein is comparable to the conventional FR nonwoven (FR cellulosic fiber/binder fiber), but has advantages in cost effectiveness.

21 Claims, No Drawings

ECONOMICAL FIRE BARRIER NONWOVEN

CROSS-REFERENCE TO RELATED APPLICATIONS

This application claims priority to U.S. Provisional Application 62/170,806 filed on Jun. 4, 2015, the complete contents of which is herein incorporated by reference.

FILED OF THE INVENTION

The invention relates to a new fire barrier nonwoven comprised or consisting of flame retardant (FR) cellulosic fiber(s) and untreated cellulosic fiber(s) and optionally binder fiber(s), wherein the FR cellulosic fiber(s) either contain or are treated with FR chemical(s) or FR compound(s) that have melting point or decomposition temperature at 400° C. (752° F.) or below.

BACKGROUND

There has been an increasing demand for fire barrier products for use in mattresses and upholstered furniture. Indeed, the U.S. federal open-flame mattress standard (CPSC 16 CFR Part 1633) has created a new demand for flame retardant (FR) fibers in the mattress industry. A number of companies have been developing nonwoven fire barriers to meet the federal standard. Examples of the approaches are described in the following issued patents.

U.S. Pat. No. 7,410,920 (Davis) describes a nonwoven fire barrier consisting of charring-modified viscose fibers (Visit®) with less than 5% of polymers made from halogenated monomers.

U.S. Pat. No. 7,259,117 (Mater et al.) discloses a nonwoven high-loft fire barrier for mattresses and upholstered furniture. The high-loft nonwoven is composed of melamine fiber alone or in conjunction with other fibers.

There are a number of synthetic FR fibers, i.e., the polymer backbone is modified to give flame retardancy. Synthetic FR fibers include aramids (Nomex® and Kevlar®), polyimide fibers (Ultem® polyetherimide and Extern® amorphous thermoplastic polyimide fibers), melamine fiber (Basofil®), halogen-containing fibers (Saran® fiber, modacrylics), polyphenylene sulfide fibers (Diofort®), oxidized polyacrylonitrile fibers (Pyron®), and cured phenol-aldehyde fibers (Kynol® novoloid fiber).

Despite their advantages, these synthetic FR fibers are expensive. From an economic perspective, most of them are not suitable for mattresses and upholstered furniture due to their high costs. For the mattress and upholstered furniture industries, the most cost-effective FR fibers are FR cellulosic fibers.

There are generally two types of FR cellulosic fibers. The first one is FR-treated cellulosic fiber. This is produced by applying FR chemicals on cellulosic fiber. Examples of cellulosic fiber include cotton, kapok, flax, ramie, kenaf, abaca, coir, hemp, jute, sisal, pineapple fiber, rayon, lyocell, bamboo fiber, Tencel®, and Modal®. FR-treated cellulosic fibers are commercially available from Tintoria Piana US, Inc. (Cartersville, Ga., USA).

The second type of FR cellulosic fiber is an inherent FR cellulosic fiber. This is produced by adding FR chemical or FR compound to viscose dope and extruding the dope to form the fiber. Examples of inherent FR cellulosic fiber include phosphorous FR-containing rayon fibers (Lenzing FR®, Shangdong Helon's Anti-frayon®), and silica-containing rayon fibers (Visit®, Daiwabo's FR Corona®fibers, Sniace's FR fiber, and Shangdong Helon's Anti-fcell®).

The most commonly used fire barrier nonwovens for the mattress industry are inherent FR rayon fiber/binder fiber and FR-treated cellulosic fiber/binder fiber. The amount of the binder fiber is typically around 15~30% of the total nonwoven weight.

Although FR cellulosic fibers provide economical fiber barrier nonwoven for mattresses, there is always industry demand for more economical solutions without sacrificing the fire barrier performance.

SUMMARY

The present invention provides a new economical fire barrier nonwoven composed of FR cellulosic fiber(s) and untreated cellulosic fiber(s). The FR performance of the new nonwoven was comparable to or better than the conventional fire barrier nonwoven (FR cellulosic fiber/binder fiber). The invented nonwoven blend is a new economical solution for the mattress industry because the substitution of some portion of the FR cellulosic fiber with untreated cellulosic fiber results in a significant cost saving, and may provide advantages in production.

Fire barrier nonwovens according to this invention will include at least one FR cellulosic fiber (FR-treated cellulosic fiber or some inherent FR cellulosic fiber where the FR-treated cellulosic fiber is treated with and the inherent FR cellulosic fiber contains FR chemicals/FR compounds having melting point or decomposition temperature at 400° C. (752° F.) or below (e.g., excludes inherent FR rayon with silica)) and at least one untreated cellulosic fiber, where the cellulosic fibers may be the same or different (e.g., the FR cellulosic fiber could the same type of fiber as the untreated cellulosic fiber or it can be a different fiber). Preferably, the FR cellulosic fiber and/or untreated cellulosic fiber will constitute at least 20 wt %, 30 wt %, 40 wt %, 50 wt %, 60 wt %, 70 wt %, or 80 wt % of the fire barrier nonwoven material assembled from the two fibers. Other fibers such as metal fibers (silver, etc.), high performance fibers (glass fibers, aramid fibers, basalt fibers, etc.), fibers which provide texture (polyester, etc.), colored fibers, etc. may also be included in the fire barrier nonwoven, depending on the application. In particular embodiments, the nonwoven may be made from a blend of fibers which includes binder fibers which melt at 185° C. or less (e.g., high melting binder fibers typically melt at or below 185° C. and low melting binder fibers typically melt at or below 120° C.) together with the FR cellulosic fiber and untreated cellulosic fiber (and any other fibers to be included in the fire barrier nonwoven material). In these embodiments, the binder fibers may constitute at least 5 wt %, 10 wt %, 15 wt %, 20 wt %, 25 wt %, or 30 wt % of the nonwoven blend. In these embodiments the binder fibers (or at least a portion thereof in the case of sheath-core binder fibers) will melt, and then on cooling will re-solidify and serve to bond the fibers together in a nonwoven fiber material. When the inventive nonwoven is exposed to fire, for example, the FR chemicals/FR compounds will melt or decompose, and will function to protect the untreated cellulosic fibers. This might be caused by the FR chemicals/FR compounds being applied on the untreated cellulosic fibers on heating, or by other mechanisms.

DETAILED DESCRIPTION

The present invention generally relates to fire barrier nonwoven made with FR cellulosic fiber, untreated cellulosic fiber, and optionally binder fiber. Binder fiber is generally required for a thermally bonded nonwoven, however, binder fiber is generally not required for mechanically or chemically bonded nonwovens.

Unexpectedly, it was found that the FR performance of the new nonwoven was comparable to or better than the conventional FR nonwoven (FR cellulosic fiber/binder fiber).

A "nonwoven" is a manufactured sheet, web, or batt of natural and/or man-made fibers or filaments that are bonded to each other by any of several means. Manufacturing of nonwoven products is well described in "Nonwoven Textile Fabrics" in Kirk-Othmer Encyclopedia of Chemical Technology, 3rd Ed., Vol. 16, Jul. 1984, John Wiley & Sons, p. 72~124 and in "Nonwoven Textiles", November 1988, Carolina Academic Press. Web bonding methods include mechanical bonding (e.g., needle punching, stitch, and hydro-entanglement), chemical bonding using binder chemicals (e.g., saturation, spraying, screen printing, and foam), and thermal bonding using binder fibers with low-melting points. Two common thermal bonding methods are air heating and calendaring. In air heating, hot air fuses low-melt binder fibers within and on the surface of the web to make high-loft nonwoven. In the calendaring process, the web is passed and compressed between heated cylinders to produce a low-loft nonwoven.

The nonwoven may be made using mechanical bonding, chemical bonding, or thermal bonding techniques. In an exemplary embodiment, hot-air thermal bonding using low-melt binder fiber are employed to manufacture the nonwoven (i.e., the low-melt binder fibers melt at a lower temperature than the melting point or decomposition temperature of FR cellulosic fibers and the untreated cellulosic fibers and serve to hold the FR cellulosic fibers and untreated cellulosic fibers together in the nonwoven). The low-melt binder fibers can be any of those commonly used for thermal bonding which include, but are not limited to, those that melt from 80 to 150° C. Examples include but are not limited to polyester and polyester copolymers. The low-melt binder fibers (and in some applications high-melt binder fibers) serve to mix readily with the other fibers of a non-woven, and to melt on application of heat and then to re-solidify on cooling to hold the other fibers in the nonwoven together. In some applications the low melt binder fibers might have a core-sheath configuration where the sheath melts on application of heat and functions to hold the other fibers of the nonwoven together. The nonwoven preferably has a basis weight of a basis weight ranging from 0.1~5.0 oz/ft$^2$ (more preferably, 0.3~2.0 oz/ft$^2$); however, the basis weight of the nonwoven can vary widely depending on the intended application and desired characteristics of the nonwoven.

FR cellulosic fibers for this invention include FR-treated cellulosic fibers, inherent FR cellulosic fibers, or a mixture of any combination of these fibers. FR chemicals/compounds for FR treatment or which are included within inherent FR cellulosic fibers in the context of this invention include, organic or inorganic FR chemicals/compounds having melting point or decomposition temperature at 400° C. (752° F.) or below. FR chemicals/compounds for FR treatment include, but are not limited to, phosphorus-containing FR chemicals/compounds, sulfur-containing FR chemicals/compounds, halogen-containing FR chemicals/compounds, and boron-containing FR chemicals/compounds. Examples of FR chemicals/compounds include, but not limited to, phosphoric acid and its derivatives, phosphonic acid and its derivatives, sulfuric acid and its derivatives, sulfamic acid and its derivatives, boric acid, ammonium phosphates, ammonium polyphosphates, ammonium sulfate, ammonium sulfamate, ammonium chloride, ammonium bromide.

Cellulosic fibers, which can be used as FR-treated or untreated in the practice of this invention, include, but are not limited to, cotton, kapok, flax, ramie, kenaf, abaca, coir, hemp, jute, sisal, and pineapple, rayon, lyocell, bamboo fiber, Tencel®, and Modal®fibers.

Inherent FR cellulosic fibers that can be used for this invention should contain FR chemicals/compounds having melting point or decomposition temperature at 400° C. (752° F.) or below. These FR chemicals/compounds are added to viscose dope before the fiber extrusion. Examples of this type of inherent FR cellulosic fibers include, but are not limited to, inherent FR rayon and inherent FR lyocell containing phosphorus FR compounds. There is silica-containing inherent FR rayon that is commonly used for fire barrier nonwoven. But the melting point of silica is much higher than 400° C. (752° F.), so the silica-containing inherent FR rayon is not applicable for the invention.

In addition to the fibers described herein, other fibers (optional fibers) may be included in the nonwoven to achieve properties or characteristics of interest (e.g., color, texture, etc.). The optional fibers may be present in sufficient quantity to provide a characteristic to said nonwoven such as softness, texture, appearance, resilience, and cost benefit. Optional fibers include any man-made fibers and natural fibers.

One would expect when untreated cellulosic fiber is mixed with FR cellulosic fiber, that FR performance of the blend would decrease due to the burning of the untreated cellulosic fiber, which would function as fuel of the burning. Surprisingly, it was found that the FR performance of the new nonwoven described herein was comparable to or better than the conventional FR nonwoven (FR cellulosic fiber/binder fiber). The nonwoven blend of the invention is a new economical solution for the mattress industry due to the substitution of some portion of the FR cellulosic fiber with untreated cellulosic fiber, which results in a significant cost saving since FR cellulosic fiber is more expensive than the untreated cellulosic fiber. The nonwoven fire barrier produced has a variety of uses including without limitation use in mattresses and upholstered furniture.

In some embodiments, the amount of the FR cellulosic fiber in the nonwoven is in the range of 5-95 wt. %, preferably 10-60 wt. %, and more preferably 20-50 wt. %. In some embodiments, the amount of the untreated cellulosic fiber in the nonwoven is in the range of 5-95 wt. %, preferably 10-60 wt. %, and more preferably 20-50 wt. %. In some embodiments, the amount of binder fiber in the nonwoven is in the range of 0-70 wt. %, preferably 5-50 wt. %, and more preferably 10-30 wt. %.

Those of skill in the art will recognize that the preferred amounts of fibers are not limited to the ranges specified above, and that, depending on the application, manufacturing process, or other conditions, the amounts of each fiber can be varied considerably within the practice of this invention, and further, that a wide variety of optional fibers may be incorporated into the nonwoven While exemplary embodiments of the present invention are described in greater detail, it is to be understood that this invention is not limited to particular embodiments described, and as such embodiments of the invention may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

The invention is further described by the following non-limiting examples which further illustrate the invention, and are not intended, nor should they be interpreted to, limit the scope of the invention.

Example 1

Thermally bonded high-loft nonwoven samples were prepared by using a nonwoven production line. FR-treated Tencel® fiber (a lyocell fiber), untreated Tencel® fiber, and low-melt binder fiber (LM) were blended at specific wt. % ratios. The blended fibers were carded to form a fiber web on a conveyor. The web is cross-lapped and passed through an oven to form a high-loft nonwoven. Samples were prepared at the same basis weight expressed as ounce per square foot (oz/ft$^2$). The nonwoven samples were tested for char strength and char enlogation using an in-house char tester. The char tester was equipped with a loadcell connected to a vertically movable steel disc which presses a char until its breakage. Elongation was measured in the unit of inches and char strength was measured as peak force in the unit of pounds (lb). Before the char test, each sample (6 inches×6 inches) was completely burned to form a char using a burner beneath the sample. The burning was done for 60 seconds for each side of the sample. While burning each side, the surface temperature of the sample was measured by an IR thermometer mounted above the sample. The highest temperature from the 2$^{nd}$ burning was recorded.

TABLE 1

Comparison of samples with/without untreated cellulosic fiber

| Fiber blends (wt. %) FR-treated Tencel ®:Untreated Tencel ®:LM | Temperature (° F.) | Elongation (inch) | Char strength (lb) |
|---|---|---|---|
| 80:0:20 | 613 | 0.310 | 1.58 |
| 65:15:20 | 618 | 0.313 | 1.71 |
| 50:30:20 | 624 | 0.313 | 1.58 |
| 35:45:20 | 641 | 0.311 | 1.36 |
| 20:60:20 | 650 | 0.303 | 1.18 |
| 0:80:20 | 890 | 0 | 0 |

1. FR chemical for the FR treatment: ammonium phosphates
2. Tencel ® fiber specification: 3 denier, 64 mm
3. All samples basis weights are same at 0.85 oz/ft$^2$ As seen in table 1, the nonwoven sample containing untreated Tencel® fiber up to 60% showed a surprisingly good performance. It is noted that the sample containing no FR-treated Tencel® showed a very high temperature and no char performance due to its complete burning (no char formation). Without being bound by theory, the good performance can be explained by the melting of the FR chemical on the FR-treated fibers and its subsequent movement to untreated fibers during the burning. This can be explained that FR chemical on the FR-treated Tencel® is melted and moved to untreated Tencel® so the untreated Tencel® becomes FR-treated Tencel® during the burning.

Example 2

Another set of thermally bonded high-loft nonwoven samples were prepared by using a nonwoven production line and tested by the same methods described in Example 1. Table 2 shows samples blend ratio and test results.

TABLE 2

Comparison of samples with/without untreated cellulosic fiber

| Fiber blends (wt. %) | Temperature (° F.) | Elongation (inch) | Char strength (lb) |
|---|---|---|---|
| Inherent FR Rayon:LM = 80:20 | 640 | 0.419 | 0.43 |
| Inherent FR Rayon:Unteated Rayon:LM = 40:40:20 | 820 | 0.251 | 0.13 |
| FR-treated Rayon:LM = 80:20 | 666 | 0.316 | 0.66 |
| FR-treated Rayon:Unteated Rayon:LM = 40:40:20 | 663 | 0.318 | 0.77 |
| FR-treated Rayon:Unteated Cotton:LM = 40:40:20 | 634 | 0.322 | 0.82 |

1. Untreated Rayon: 3 denier, 60 mm
2. FR chemical for the FR-treated Rayon: ammonium phosphates
3. Inherent FR Rayon (slica-containing inherent FR rayon): 3 denier, 60 mm
4. All samples basis weights are same at 0.85 oz/ft$^2$ As seen in table 2, the nonwoven sample containing untreated rayon and cotton fiber showed a surprisingly good performance. Without being bound by theory, the good performance can be explained by the melting of the FR chemical on the FR-treated rayon and its subsequent movement to untreated fibers during the burning. It is notable that this effect is shown only by FR-treated cellulosic fiber/untreated cellulosic fiber (rayon or cotton) blend. This effect is not shown by inherent FR rayon/untreated cellulosic (rayon) blend, which can be explained by the fact that the inherent FR rayon used for this test does not contain FR chemical/compound that melts at 400° C. (752° F.) or less. Rather, the inherent FR rayon contains silica as flame retardant material, which melts at much higher than 400° C. (752° F.). That means, for this blend, there was no melted flame retardant movement to the untreated rayon fiber during the burning, so the untreated rayon fiber part is burned and as the result the burn temperature is much higher and char performance is much worse (reduction in elongation and char strength) than 80% inherent FR Rayon/20% LM blend.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A fire barrier nonwoven, comprising:

10-80 wt % of at least one flame retardant (FR) cellulosic fiber, wherein said at least one FR cellulosic fiber contains or is treated with FR chemicals or FR compounds having a melting point or decomposition temperature at 400° C. (752° F.) or below; and 10-80 wt % of at least one untreated cellulosic fiber, said at least one untreated cellulosic fiber being the same or different cellulosic fiber used to make said FR cellulosic fiber, wherein said at least one untreated cellulosic fiber is selected from the group consisting of cotton, kapok, flax, ramie, kenaf, abaca, coir, hemp, jute, sisal, pineapple, rayon, lyocell, and bamboo, and wherein said at least one FR cellulosic fiber and said at least one untreated cellulosic fiber are assembled together as a fiber barrier nonwoven material.

2. The fire barrier nonwoven of claim 1 further comprising one or more fibers which are different from said at least one FR cellulosic fiber and said at least one untreated cellulosic fiber.

3. The fire barrier nonwoven of claim 2 wherein said one or more fibers which are different from said at least one FR cellulosic fiber and said at least one untreated cellulosic fiber include one or more of metal fibers, high performance fibers, polyester fibers, and colored fibers.

4. The fire barrier of claim 3 wherein said high performance fibers are selected from glass fibers, aramid fibers, and basalt fibers.

5. The fire barrier nonwoven of claim 1 wherein said fire barrier nonwoven material is assembled together by a bonding material which bonds fibers together.

6. The fire barrier nonwoven of claim 5 wherein said bonding material is formed from melted binder fibers or melted surface portions of binder fibers.

7. The fire barrier nonwoven of claim 5 wherein said bonding material is formed from a chemical reaction involving at least one of said at least one FR cellulosic fiber and said at least one untreated cellulosic fiber.

8. The fire barrier nonwoven of claim 1 wherein said fire barrier nonwoven material is assembled from a mechanical interconnection involving at least one of said at least one FR cellulosic fiber and said at least one untreated cellulosic fiber.

9. The fire barrier nonwoven of claim 1 wherein one or more of said at least one FR cellulosic fiber and said at least one untreated cellulosic fiber constitute at least 40 wt % of said fire barrier nonwoven material.

10. The fire barrier nonwoven of claim 1 wherein said FR chemicals or FR compounds are selected from the group consisting of phosphorus-containing FR chemicals or compounds, sulfur-containing FR chemicals or compounds, halogen-containing FR chemicals or compounds, and boron-containing FR chemicals or compounds.

11. The fire barrier nonwoven of claim 1 wherein said at least one FR cellulosic fiber is an FR-treated cellulosic fiber selected from the group consisting of cotton, kapok, flax, ramie, kenaf, abaca, coir, hemp, jute, sisal, pineapple, rayon, lyocell, and bamboo.

12. A nonwoven for forming a fire barrier nonwoven, comprising:

10-80 wt % of at least one flame retardant (FR) cellulosic fiber, wherein said at least one FR cellulosic fiber contains or is treated with FR chemicals or FR compounds having a melting point or decomposition temperature at 400° C. (752° F.) or below;

10-80 wt % of at least one untreated cellulosic fiber, said at least one untreated cellulosic fiber being the same or different cellulosic fiber used to make said FR treated cellulosic fiber, wherein said at least one untreated cellulosic fiber is selected from the group consisting of cotton, kapok, flax, ramie, kenaf, abaca, coir, hemp, jute, sisal, pineapple, rayon, lyocell, and bamboo; and at least 5 wt % of at least one binder fiber which has a melting temperature below 185° C.

13. The nonwoven of claim 12 further comprising one or more fibers which are different from said at least one FR cellulosic fiber, said at least one untreated cellulosic fiber, and said at least one binder fiber.

14. The nonwoven of claim 12 nonwoven wherein said at least one FR cellulosic fiber is an FR-treated cellulosic fiber selected from the group consisting of cotton, kapok, flax, ramie, kenaf, abaca, coir, hemp, jute, sisal, pineapple, rayon, lyocell, and bamboo.

15. The nonwoven of claim 12 wherein said at least one binder fiber constitutes 10-30 wt % of the nonwoven.

16. The nonwoven of claim 12 wherein said at least one untreated cellulosic fiber comprises one or more of rayon and cotton.

17. The nonwoven of claim 16 wherein said at least one FR cellulosic fiber comprises rayon.

18. The nonwoven of claim 12 wherein said at least one FR cellulosic fiber constitutes 10-65 wt % of said nonwoven, wherein said at least one untreated cellulosic fiber comprises 10-60 wt % of said nonwoven, and wherein said at least one binder fiber constitutes 10-30 wt % of the nonwoven.

19. The fire barrier nonwoven of claim 1 wherein said at least one untreated cellulosic fiber comprises one or more of rayon and cotton.

20. The fire barrier nonwoven of claim 19 wherein said at least one FR cellulosic fiber comprises rayon.

21. The fire barrier nonwoven of claim 1 further comprising at least one binder fiber which constitutes 10-30 wt % of the nonwoven.

* * * * *